United States Patent [19]

Anderson

[11] 4,304,083

[45] Dec. 8, 1981

[54] ANCHOR ELEMENT FOR PANEL JOINT

[75] Inventor: John W. Anderson, Stockton, Calif.

[73] Assignee: H. H. Robertson Company, Pittsburgh, Pa.

[21] Appl. No.: 87,696

[22] Filed: Oct. 23, 1979

[51] Int. Cl.[3] ..... E04C 1/00

[52] U.S. Cl. ..... 52/509; 52/309.9; 52/586

[58] Field of Search ..... 52/309.7, 309.9, 483, 52/509, 586

[56] References Cited

U.S. PATENT DOCUMENTS

| | | | |
|---|---|---|---|
| 2,143,288 | 1/1939 | Stolz | 52/586 |
| 3,372,520 | 3/1968 | Hensel | 52/483 |
| 3,627,362 | 12/1971 | Brenneman | 52/586 |
| 3,641,720 | 2/1972 | Berrie | 52/586 |
| 3,680,277 | 8/1972 | Martin | 52/586 |
| 3,714,747 | 2/1973 | Carran | 52/483 |
| 3,777,430 | 12/1973 | Tischuk | 52/309.9 |
| 3,998,023 | 12/1976 | Anderson | 52/393 |
| 4,184,301 | 1/1980 | Anderson | 52/309.9 |

FOREIGN PATENT DOCUMENTS

| | | | |
|---|---|---|---|
| 1530016 | 6/1968 | France | 52/586 |
| 430131 | 8/1967 | Switzerland | 52/483 |
| 590923 | 7/1947 | United Kingdom | 52/586 |
| 1244155 | 8/1971 | United Kingdom | 52/586 |

*Primary Examiner*—Price C. Faw, Jr.
*Assistant Examiner*—Henry E. Raduazo
*Attorney, Agent, or Firm*—George E. Manias

[57] ABSTRACT

An anchor element inserted through the end of a panel joint into the joint cavity provides an anchor site. Components, such as window frames, flashings, girts and the like, are secured to the anchor element by positive fasteners. Integrally formed flexible arms retain the anchor element in fixed position until its anchoring function is required.

7 Claims, 6 Drawing Figures

ANCHOR ELEMENT FOR PANEL JOINT

BACKGROUND OF THE INVENTION

1. Field of the Invention

This invention relates to wall structures, and more particularly to improved means for securing extrinsic components to the wall structure.

2. Description of the Prior Art

Wall structures are known which are assembled from double-skin insulated panels, see U.S. Pat. No. 3,777,430 (TISCHUK). Components, such as window frames, flashings, girts and the like, are secured to the wall structure during construction. Such components extend along coterminating ends of the panels. The fastening of the components normally occurs from the backside or inboard face of the panels.

Backside fastening has been accomplished by means of expansion-type fasteners extending through the relatively light gauge inner skin of the panel. Such backside fastening may cause delamination of the inner skin from the core under certain conditions.

To avoid the delamination problem, profiled inserts have been introduced into the panel during its fabrication to provide a rigid member to which the extrinsic components may be secured, see, for example, U.S. Pat. No. 3,998,023 (ANDERSON). This method has at least two serious disadvantages. Firstly, the introduction of the stiffening elements disrupts the normally smooth panel assembly process in the plant. Secondly, this method requires the introduction of the stiffening element into substantially all fabricated panels inasmuch as it is not normally known in advance where such extrinsic components are to be secured to the wall structure.

SUMMARY OF THE INVENTION

The principal object of this invention is to provide a wall structure having improved anchor sites to which extrinsic components are secured.

Another object of this invention is to provide a novel anchor element which allows fastening of components to and at the strongest part of the wall structure.

Still another object of this invention is to provide a novel anchor element which is introduced into a joint cavity where desired and which remains in place until its anchoring function is needed.

The present invention is directed to an improvement in a joint between adjacent panels of a wall structure wherein overlapping inboard and outboard panel portions present spaced-apart confronting faces which define a joint cavity extending lengthwise of the joint. The present improvement comprises an anchor bar disposed within the joint cavity and engaged with a first of the confronting faces. Retention means is provided which retains the anchor bar in a substantially fixed position within the joint cavity until its anchoring function is required. The retention means comprises at least one and preferably two resilient arms extending from the anchor bar into engagement with one of the confronting faces. During insertion into the joint cavity, the arms are flexed and urge the anchor bar into engagement with the first of the confronting faces.

Further in accordance with this invention, a component to be secured to the wall structure has a flange portion adjacent to one face of the wall structure. Fastening means is provided which penetrates the flange portion and one of the panel portions secures the component to the anchor bar and to the wall structure.

BRIEF DESCRIPTION OF THE PREFERRED EMBODIMENT(S)

Figure 1:
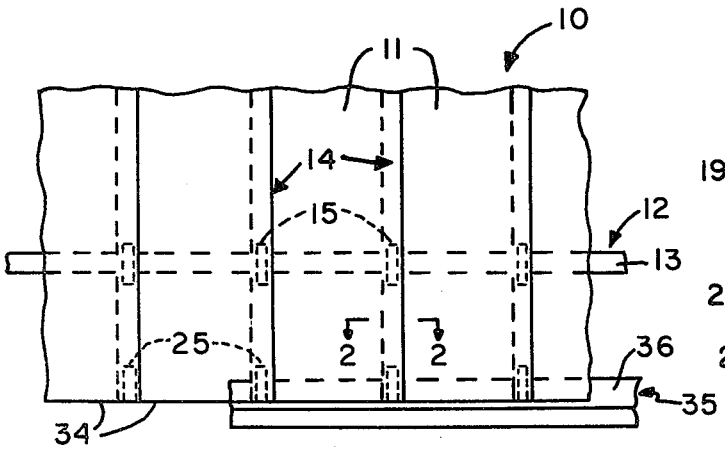
FIG. 1 is a fragmentary elevation view of a typical wall structure incorporating the anchor sites of this invention.

FIG. 1 illustrates a wall structure 10 comprising plural panels 11 secured to a structural framework 12 of which only a subgirt 13 is visible. The panels 11 are assembled in side-by-side relation and present plural joints 14. The joints 14 may permit lateral adjustment of the panels 11 to conform the coverage of the panels 11 with that required by the structural steel. Such a joint is described and claimed in the TISCHUK '430 patent, supra. The panels 11 may be secured to the subgirt 13 by clips 15 in the manner described in the TISCHUK '430 patent, supra.

Figure 2:
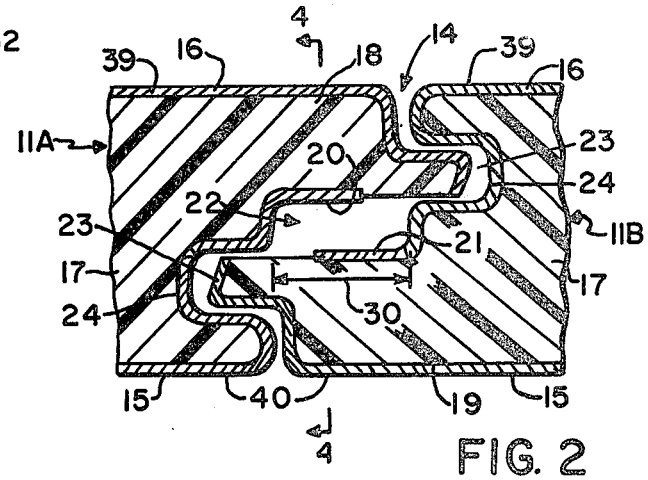
FIG. 2 is a cross-sectional view taken along the line 2—2 of FIG. 1 illustrating a joint between adjacent panels.

One of the joints 14 between adjacent panels 11A, 11B is illustrated in FIG. 2. Each of the panels 11A, 11B comprises inner and outer skins 15, 16, respectively, and a core 17 connecting the inner skin 16 in shear-transferring relation to the outer skin 15. The core 17 may comprise, for example, foamed-in-place plastics composition, insulated honeycomb cores and the like.

The panels 11A, 11B present, respectively, inboard and outboard panel portions 18, 19 disposed in overlapping relation, and inboard and outboard exterior faces 39, 40. The panel portions 18, 19 present interior confronting faces 20, 21 which are spaced-apart and define a joint cavity 22 extending lengthwise of the adjacent panels 11A, 11B. Complementary mating elements such as a tongue 23 and a complementary groove 24 may be provided at the outer skins 15 and, if desired, also at the inner skins 16.

Figure 3:
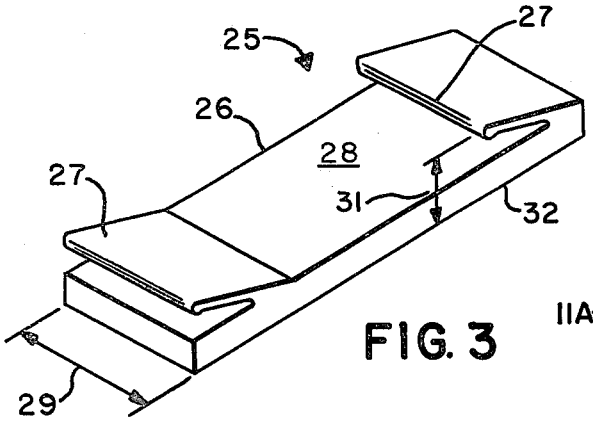
FIG. 3 is an isometric view of the present anchor element.

The present invention provides an anchor element 25 (FIG. 3) comprising a bar 26 having at least one and preferably two relatively thin arms 27 formed integrally therewith. The arms 27 preferably are inclined outwardly from an outer face 28 of the bar 26. The anchor element 25 may be formed from aluminum by an extrusion process. The bar 26 is cut from the extrusion to a width 29 which preferably is less than the minimum achievable width 30 (FIG. 2) of the joint cavity 22. The anchor element 25 has a depth 31—distance between the tip of each arm 27 and the rear face 32 of the bar 26—which is greater than the interior depth 33 (FIG. 4) of the joint cavity 22.

Figure 4:
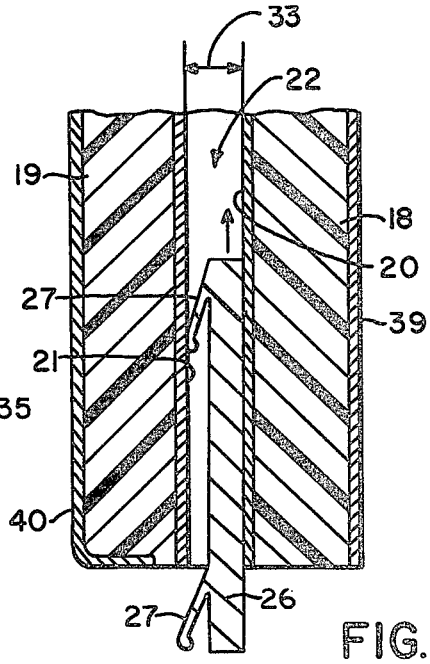
FIG. 4 is a cross-sectional view taken along the line 4—4 of FIG. 2 illustrating the installation of the anchor element of FIG. 3.

As shown in FIG. 4, the bar 26 is inserted through the end of a panel joint into the joint cavity 22. Because of the elasticity of the arms 27, they are flexed during insertion and frictionally retain the bar 26 in the substantially fixed position illustrated in FIG. 5. Reverting to FIG. 1, an anchor element 25 may be inserted into certain or all of the joints 14—the anchor element 25 being frictionally retained in position until their anchoring function is required.

Figure 5:
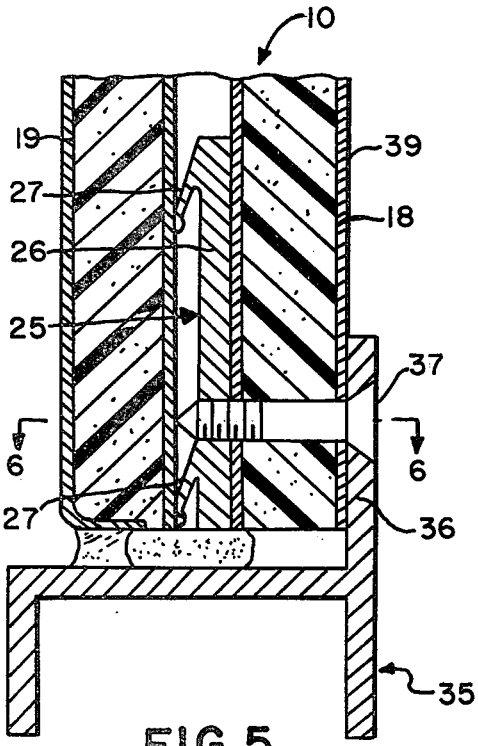
FIG. 5 is a cross-sectional view taken along the line 5—5 of FIG. 6 illustrating a flashing member secured to the anchor element.
Figure 6:
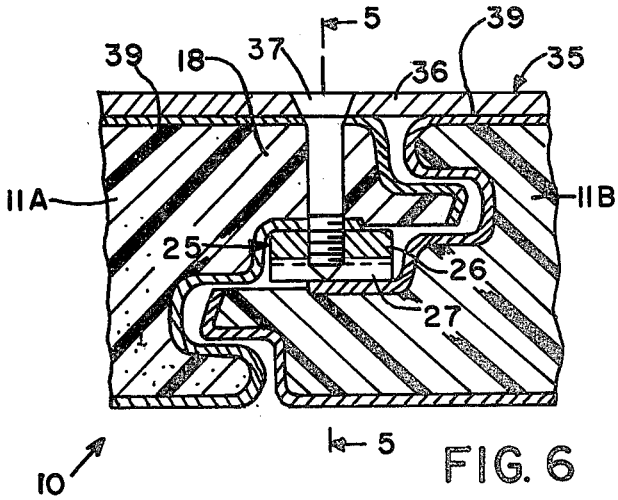
FIG. 6 is a cross-sectional view taken along the line 6—6 of FIG. 5.

FIGS. 1 and 5 illustrate a component such as a flashing 35 extending along coterminating ends 34 (FIG. 1) of adjacent panels 11. The flashing 35 presents a flange portion 36 confronting the inboard exterior face 39 of the wall structure 10. During installation, the flashing 35 is retained in position and a series of aligned holes are drilled through the flange portion 36, the inboard panel portion 18 and the bar 26. Thereafter fastener means, such as a positive fastener 37, penetrates the flange portion 36, the inboard panel portion 18 and secures the component 35 to the anchor bar 26. It will be appreciated that since the flexed arms 27 retain the anchor element 25 in place during drilling and fastening, alignment of the drilled holes is not a problem.

From the foregoing description it will be appreciated that the present invention provides a wall structure having improved anchor sites to which components may be readily and firmly secured. In addition, the present invention provides a novel anchor element which allows fastening of components to and at the strongest part of a wall structure. The present arrangement takes advantage of the inherent strength of the joint between panels. Furthermore, the present invention also provides a novel anchor element which is introduced into a joint cavity where desired and which remains in place until its anchoring function is needed. That is, the resilient arms provide functional forces which resist disengagement of the anchor element from the joint cavity.

I claim:

1. A joint between adjacent panels of a wall structure, said wall structure presenting inboard and outboard exterior faces and comprising:

overlapping inboard and outboard panel portions, one presented by each of said panels, said panel portions presenting spaced-apart interior confronting faces which define a generally rectangular joint cavity extending lengthwise of said joint, said joint cavity having a cavity width measured parallel with said exterior faces;

an anchor bar disposed in said joint cavity and engaging the confronting face of one of said panel portions, said anchor bar having a width which is less than said cavity width; and retention means engaging the confronting face of the other of said panel portions and frictionally retaining said anchor bar in substantially fixed position within said joint cavity.

2. The joint of claim 1 wherein said retention means comprises at least one arm formed integrally with and extending along a face of said anchor bar and being inclined relative thereto, said arm engaging said other confronting face, being flexed thereby and urging said anchor bar into engagement with said first of said confronting faces.

3. The joint of claim 2 wherein said retention means includes a second arm formed integrally with and extending along said face, said second arm being spaced from and generally parallel with the first said arm and being inclined relative to said anchor bar in the same direction as the first said arm.

4. The joint of claim 1 including:

a component having a flange portion adjacent one of said exterior faces of said wall structure; and fastening means penetrating said flange portion and one of said panel portions, securing said component to said anchor bar.

5. The joint of claim 4 wherein said flange portion engages an inboard face of said wall structure.

6. Joint of claim 1, 2, 3 or 4 wherein said anchor bar is inserted through an end of said joint cavity situated at co-terminating panel ends.

7. A joint between adjacent panels which are laterally adjustable relative to each other, said joint comprising:

overlapping inboard and outboard panel portions, one presented by each of said panels, said panel portions presenting spaced-apart interior confronting faces which define a generally rectangular joint cavity extending lengthwise of said joint, said joint cavity having a variable cavity width measured parallel with said exterior faces;

an anchor bar disposed in said joint cavity and engaging the confronting face of one of said panel portions, said anchor bar having a width which is less than the minimum achievable width of said joint cavity; and retention means engaging the confronting face of the other of said panel portions and frictionally retaining said anchor bar in substantially fixed position within said joint cavity.

* * * * *